US009436130B2

(12) United States Patent
Sakamaki

(10) Patent No.: US 9,436,130 B2
(45) Date of Patent: Sep. 6, 2016

(54) DEVELOPING DEVICE

(71) Applicant: CANON KABUSHIKI KAISHA, Tokyo (JP)

(72) Inventor: Tomoyuki Sakamaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/855,605

(22) Filed: Sep. 16, 2015

(65) Prior Publication Data

US 2016/0085181 A1 Mar. 24, 2016

(30) Foreign Application Priority Data

Sep. 24, 2014 (JP) ..... 2014-193466

(51) Int. Cl.
*G03G 15/08* (2006.01)

(52) U.S. Cl.
CPC ..... *G03G 15/0891* (2013.01)

(58) Field of Classification Search
CPC ..... G03G 15/0887; G03G 15/0891
See application file for complete search history.

(56) References Cited

U.S. PATENT DOCUMENTS 6,973,281 B2 12/2005 Hirobe et al.
7,099,609 B2 8/2006 Hirobe et al.
7,231,154 B2 6/2007 Sakamaki
7,991,332 B2 8/2011 Sakamaki
8,355,655 B2 1/2013 Sakamaki
2012/0014719 A1* 1/2012 Hayashi ..... G03G 15/0853 399/254
2013/0243489 A1 9/2013 Sakamaki

FOREIGN PATENT DOCUMENTS

JP H02-021591 B2 5/1990
JP H11-219013 A 8/1999
JP 2000-112238 A 4/2000
JP 2005-017497 A 1/2005
JP 2012-194351 A 10/2012
JP 2014-052575 A 3/2014

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

A developing device includes a developing container for accommodating a developer, a feeding member, including a blade for feeding the developer, and a discharge opening for permitting discharge of excessive developer. A winding direction of the blade ascends toward a downstream developer feeding direction. A first lower intersection position between a downstream edge of the discharge opening and a first cross-section perpendicular to a rotational axis of the feeding member and crossing the discharge opening is a first position, and a second lower intersection position between the downstream edge of the discharge opening and a second cross-section which is perpendicular to a rotational axis of the feeding member and crossing the discharge opening and which is provided downstream of the first cross-section is a second position, and the discharge opening is configured so that the second position is higher than the first position.

9 Claims, 9 Drawing Sheets

(a)

(b)

DEVELOPING DEVICE

FIELD OF THE INVENTION AND RELATED ART

The present invention relates to a developing device for developing an electrostatic latent image formed on an image bearing member to form a visible image by an electrophotographic process, an electrostatic recording process, or the like.

In a conventional image forming apparatus of an electrophotographic type or an electrostatic recording type, the electrostatic latent image formed on the image bearing member such as a photosensitive drum is developed by the developing device. As such a developing device, a developing device having a constitution in which in order to suppress deterioration in charging performance of a developer, the developer is supplied by a supplying device and an excessive developer excess in amount in a developing container by the supply of the developer is discharged through a developer discharge opening provided at a wall surface of the container has been proposed (Japanese Patent Publication Hei 2021591).

However, in the case of the constitution in which the developer discharge opening is provided as described above, there is a possibility that the developer which is not the excessive developer is also discharged. That is, in the developing device, the developer is fed by a screw (feeding member) provided with a blade on a rotation shaft, but at this time, jumping of the developer by the blade is generated, so that there is a possibility that the developer which is not the excessive developer is discharged through the developer discharge opening.

For this reason, a developing device constituted so that a force, with respect to a circumferential direction or an outward radial direction, acting on the developer by rotation of the screw in an opposing region to the developer discharge opening is made smaller than a force in another region has been proposed (Japanese Laid-Open Patent Application (JP-A) 2000-112238). Specifically, a constitution in which the blade of the screw in the opposing region to the developer discharge opening is made small or a constitution in which the blade in this region is omitted (removed) is employed.

On the other hand, in order to quickly stabilize a developer amount in the container even in the case where a supplied developer abruptly increase, also a structure in which the developer discharge opening is formed so that a lower end thereof is such as to ascend toward an upstream with respect to a developer feeding direction has been proposed (JP-A Hei 11-219013).

However, as in the constitution disclosed in JP-A 2000-112238, in the case where the screw blade in the opposing region to the developer discharge opening is made smaller or is omitted, the following problem arises. That is, by employing such a constitution, (developer) feeding power of the screw in the opposing region to the developer discharge opening becomes small compared with that in a downstream region of the developer discharge opening with respect to the developer feeding direction. As a result, the developer in the opposing region to the developer discharge opening is liable to stagnate, and thus a developer surface is not stabilized and unstable discharge of the developer is repeated, so that there is a possibility that a desired discharge characteristic cannot be obtained.

On the other hand, in the case of the constitution disclosed in JP-A Hei 11-219013, the developer discharge opening is formed so that the lower end thereof becomes higher toward the upstream with respect to the developer feeding direction, but a shape thereof in a downstream side with respect to the developer feeding direction is not particularly defined. In the case of the constitution disclosed in JP-A Hei 11-219013, the lower end of the developer discharge opening is unchanged in position thereof even in the downstream side with respect to the developer feeding direction, and the developer discharge opening is formed so that a line connecting the lower end and an upper end is perpendicular to the lower end at a downstream end portion of the developer discharge opening. In other words, a side edge of the developer discharge opening in the downstream side with respect to the developer feeding direction is not inclined.

Here, in many cases, the developer discharge opening is formed at an opposing position to a portion where the screw blade rotates from above toward below. For this reason, the developer caused to jump by the blade is discharged in a large amount at a position below the developer discharge opening also by the influence of gravitation. Further, in order to feed the developer, the screw blade is formed so that a portion (opposing portion) opposing a side wall of the developing container where the developer discharge opening is such as to ascend toward the downstream with respect to the developer feeding direction. Then, when the screw is rotated for feeding the developer, apparently, this opposing portion of this screw moves through an opposing region, to the developer discharge opening in the developer feeding direction, so that during a period of this movement, discharge of the developer by jumping is made.

Accordingly, in order to suppress the discharge of the developer by jumping, not only the discharge of the developer by jumping at the position below the developer discharge opening is suppressed but also a time of movement of the opposing portion of the blade through the opposing region to the developer discharge opening may only be required to be shortened. On the other hand, in the case of the constitution disclosed in JP-A Hei 11-219013, the developer discharge opening is formed so that the lower end becomes higher toward the upstream with respect to the developer feeding direction. For this reason, when the opposing portion of the blade starts to move through the opposing region to the developer discharge opening, it would be considered that the discharge of the developer by jumping can be suppressed at the position below the developer discharge opening.

However, a time of movement of the opposing portion of the blade through the opposing region to the developer discharge opening is unchanged relative to a corresponding time in the case of a rectangular discharge opening in which a length with respect to the developer feeding direction is the same and in which the upstream side with respect to the developer feeding direction is not inclined. That is, assuming that the opposing portion of the blade is larger than a vertical length of the developer discharge opening, the opposing portion of the blade moves through the rectangular discharge opening from a corner portion between an upstream edge and an upper end to a corner portion between a downstream side edge and a lower end. On the other hand, in the case of the constitution disclosed in JP-A Hei 11-219013, the opposing portion of the blade moves through the developer discharge opening from a corner portion between an inclined upstream edge and an upper end to a corner portion between a downstream side edge and a lower end. Here, the lengths of the respective discharge openings with respect to the developer feeding direction are the same, so that also the corresponding movement times are the same.

For this reason, even when the developer discharge opening is formed so that the lower end becomes higher toward the upstream with respect to the developer feeding direction, the movement time of the opposing portion is unchanged relative to that in the case of the rectangular discharge opening having the same length with respect to the developer feeding direction, so that the discharge of the developer by jumping cannot be suppressed sufficiently.

SUMMARY OF THE INVENTION

In view of the above-described circumstances, the present invention has been accomplished in order to realize a constitution capable of sufficiently suppress discharge of a developer by jumping.

According to an aspect of the present invention, there is provided a developing device comprising: a developing container for accommodating a developer; a feeding member, including a blade helically extending on a rotation shaft, for feeding the developer in the developing container along the rotation shaft by rotation thereof in a developer feeding direction; and a discharge opening for permitting discharge of an excessive developer, with supply of the developer, from the developing container, the discharge opening being provided in the developing container and being configured to open independently of an amount of the developer in the developing container, wherein the blade is rotatable such that the blade moves downwardly at a side opposing to the discharge opening, wherein a winding direction of the blade is such as to ascend toward the downstream with respect to the developer feeding direction, at the opposing side, and wherein a bottom end of the downstream edge of the discharge opening in a first cross-section taken perpendicularly to the rotation shaft is at a higher level than in a second cross-section at an upstream of the first cross-section with respect to the developer feeding direction.

These and other objects, features and advantages of the present invention will become more apparent upon a consideration of the following description of the preferred embodiments of the present invention taken in conjunction with the accompanying drawings.

DESCRIPTION OF THE EMBODIMENTS

<First Embodiment>

Figure 1:
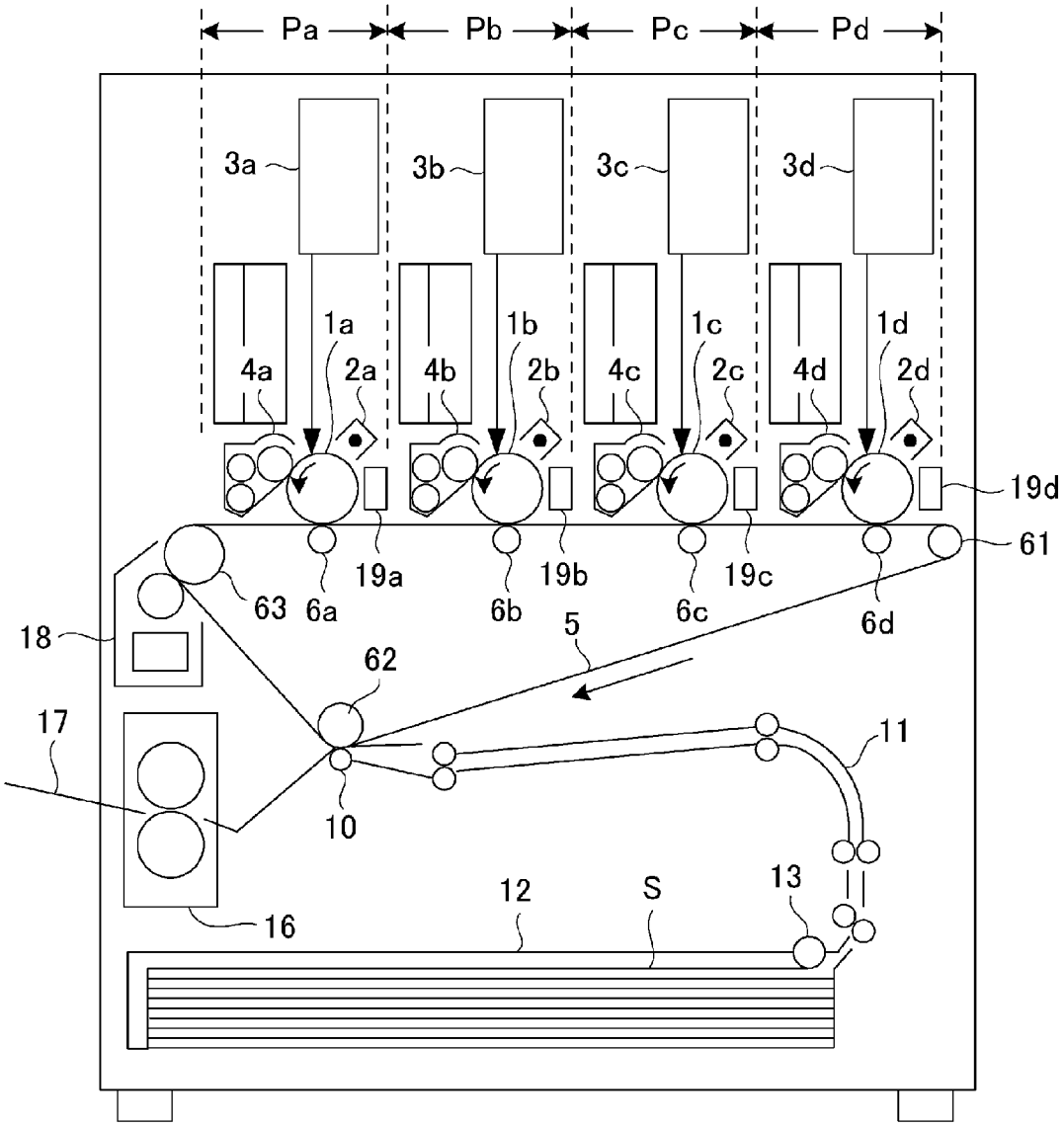
FIG. 1 is a schematic sectional view of a structure of an image forming apparatus according to a First Embodiment of the present invention.

A First Embodiment of the present invention will be described with reference to FIGS. 1-13. First, a general structure of an image forming apparatus in this embodiment will be described with reference to FIG. 1.

[Image Forming Apparatus]

An image forming apparatus in this embodiment is a full-color image forming apparatus employing an electrophotographic type and includes four image forming portions P (Pa, Pb, Pc, Pd). Constitutions of the respective image forming portions P are substantially the same except that development colors are different from each other, and therefore in the case where there is no need to particularly distinguish the constitutions, suffixes, a, b, c, d added to reference numerals or symbols for representing elements or portions of the associated image forming portions will be omitted and will be described collectively.

Each of the image forming portions P includes a drum-shaped electrophotographic photosensitive member, i.e., a photosensitive drum 1, rotating in an arrow direction (counterclockwise direction), as an image bearing member for carrying a toner image. Around the photosensitive drum 1, image forming means including a charger 2, a laser beam scanner 3 as an exposure means, a developing device 4, a transfer roller 6, a cleaning means 19 and the like.

An image forming sequence in a normal mode of an entirety of the image forming apparatus having the above constitution will be described. First, the photosensitive drum 1 is electrically charged uniformly. In the normal mode, the photosensitive drum 1 rotates in the counterclockwise direction indicated by the arrow at a process speed (peripheral speed) of, e.g., 273 mm/sec. The uniformly charged photosensitive drum 1 is subjected to scanning exposure by the laser beam scanner 3 to laser light modulated by an image signal.

The laser beam scanner 3 incorporates therein a semiconductor laser, and this semiconductor laser is controlled on the basis of inputted image data and emits the laser light. For example, the semiconductor laser is controlled correspondingly to an original image information signal (image data) inputted from an original reader including a photoelectric conversion element such as a CCD or correspondingly to the image information signal inputted from an external terminal, and emits the laser light. As a result, a surface potential of the photosensitive drum 1 charged by the charger 2 changes at an image portion, so that an electrostatic latent image is formed on the photosensitive drum 1. In this embodiment, the charger 2 and the laser beam scanner 3 as described above constitute an electrostatic latent image forming means.

The thus formed electrostatic latent image on the photosensitive drum 1 is reversely developed with a toner by the developing device 4 into a visible image, i.e., a toner image. In this embodiment, the developing device 4 uses, as a developer, a two-component developer containing the toner and a carrier is used for a two-component developing system. That is, each of the developing devices 4*a*, 4*b*, 4*c*, 4*d* accommodates the two-component developer containing the toner of an associated color. Specifically, the developing devices 4*a*, 4*b*, 4*c*, 4*d* accommodate the toners of yellow (Y), magenta (M), cyan (C), black (K), respectively. Accordingly, the above-described steps are performed every one of the image forming portions Pa, Pb, Pc, Pd, so that the four color toner images of yellow, magenta, cyan, black are formed on the photosensitive drums 1*a*, 1*b*, 1*c*, 1*d*, respectively.

At a position under the image forming portions Pa, Pb, Pc, Pd, an intermediary transfer belt 5 which is an intermediary transfer member is provided. The intermediary transfer belt 5 is stretched by rollers 61, 62, 63 and is movable in an arrow direction. The toner images on the photosensitive drums 1 are successively transferred once onto the intermediary transfer belt 5 as the intermediary transfer member by primary transfer rollers 6. As a result, the four color toner images of yellow, magenta, cyan, black are superposed on the intermediary transfer belt 5, so that a full-color image is formed. The toner remaining on the photosensitive drum 1 without being transferred onto the intermediary transfer belt 5 is collected by a cleaning means 19.

The full-color image on the intermediary transfer belt 5 is transferred by the action of a secondary transfer roller 10 onto a recording material S such as a sheet (paper, OHP sheet and so on) which is taken out from a sheet feeding cassette 12 and which passes through a sheet feeding roller 13 and a sheet feeding guide 11. The toner remaining on the surface of the intermediary transfer belt 5 without being transferred onto the recording material S is collected by an intermediary transfer belt cleaning means 18. On the other hand, the recording material S on which the full-color toner image is transferred is sent to a fixing device (heat roller fixing device) 16, where fixing of the image is made, and then the recording material S is discharged onto the discharge tray 17.

In this embodiment, as the image bearing member, the photosensitive drum 1 which is a drum-shaped organic photosensitive member which is ordinarily used was used, but it is also possible to use an inorganic photosensitive member such as an amorphous silicon photosensitive member. Further, it is also possible to use a belt-shaped photosensitive member. Also with respect to the charging type, the transfer type, the cleaning type and the fixing type, they are not limited to those described above.

[Developing Device]

The developing device 4 in this embodiment will be described with reference to FIGS. 2 and 3. The developing device 4 includes a developing container 22 accommodating the two-component developer, a developing sleeve 24 as a developer carrying member and first and second feedings screw 25, 26 as the feeding member. Further, the developing device 4 in this embodiment is of a vertical stirring type, and therefore the inside of the developing container 22 is vertically divided by a partition wall 27 into a developing chamber 23 and a stirring chamber 24 which are an accommodating portion. A substantially central portion of the partition wall 27 extends in the direction perpendicular to the drawing sheet of FIG. 2. The developer is accommodated in the developing chamber 23 and the stirring chamber 24.

In the developing chamber 23 and the stirring chamber 24, the first and second feeding screws 25 and 26 are disposed, respectively. The first feeding screw 25 is disposed, at the bottom portion of the upper-side developing chamber 23, roughly in parallel to the axial direction of the developing sleeve 24. It feeds the developer in the developing chamber 23 in one direction along the axial line of the developing sleeve 28 while stirring the developer by being rotated clockwisely in FIG. 2. The reason why the first feeding screw is rotated clockwisely is that the clockwise rotation is advantageous from the viewpoint of supply of the developer to the developing sleeve 28. The second feeding screw 26 is disposed, at the bottom portion of the lower-side stirring chamber 24, roughly in parallel to the first feeding screw 25 and is rotated in an opposite direction (counterclockwisely) to the rotational direction of the first feeding screw 25. It feeds the developer in the stirring chamber 24 in the direction opposite to that of the first feeding screw 25 while stirring the developer.

Thus, by the feeding of the developer through the rotation of the first and second feeding screws 25 and 26, the developer is circulated between the developing chamber 23 and the stirring member 24 through openings 11 and 12 (FIG. 3) (that is, communicating portions) formed at both ends of the partition wall 27. In this embodiment, the developing chamber 23 and the stirring chamber 24 are vertically disposed. However, the present invention is also applicable to a developing device in which the developing chamber 23 and the stirring chamber 24 are horizontally disposed as in a conventionally used developing device and developing devices of other types.

The developing container 22 is provided with an opening at a position corresponding to a developing position where the developing container 22 opposes the photosensitive drum 1. At this opening, the developing sleeve 28 is rotatably disposed so as to be partially exposed toward the photosensitive drum 1. The developing sleeve 28 carries and feeds the developer in the developing container 22 and supplies the developer to the developing position of the photosensitive drum 1. A chain (magnetic brush) of the developer carried on the developing sleeve 28 is regulated in length (coating amount) by a regulating blade 29 as a trimming member. Here, diameters of the developing sleeve 28 and the photosensitive drum 1 are, e.g., 20 mm and 80 mm, respectively, and a distance in the closest area between the developing sleeve 28 and the photosensitive drum 1 is, e.g., about 400 μm. As a result, the chain of the developer fed to the developing position in a state in which the length of the developer carried on the developing sleeve 28 is regulated by the regulating blade 29 is set so that development of the electrostatic latent image on the photosensitive drum 1 can be effected into contact with the photosensitive drum 1.

The developing sleeve 28 is formed of nonmagnetic material such as aluminum and stainless steel, and inside thereof, a magnetic roller 24*m* as a magnetic field generating means is non-rotatably disposed. The magnet roller 28*m* has a developing pole S2 disposed opposed to the photosensitive drum 1 at the developing position. Further, the magnet roller 28*m* has magnetic poles S1, S2, a magnetic pole N2 disposed between the magnetic poles S1, S2, and magnetic poles N1, N3 disposed opposed to the developing chamber 23 and the stirring chamber 24, respectively.

Figure 2:
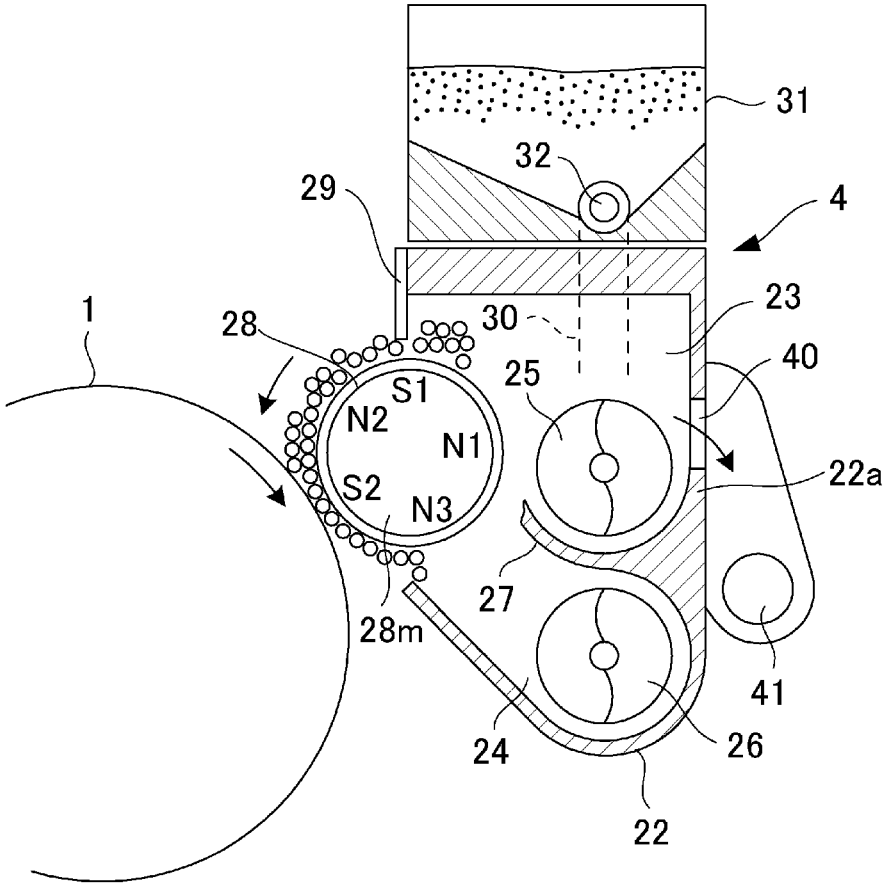
FIG. 2 is a schematic cross-sectional view of a developing device according to the First Embodiment.

Thus, the developing sleeve 28 in which the magnet roller 28*m* is provided is rotated in the direction indicated by an arrow (counterclockwise direction) in FIG. 2 to feed the developer while carrying the developer. Then, the developing sleeve 28 feeds the layer thickness-regulated developer by cutting of the chain of the magnetic brush with the regulating blade 29 to a developing region in which the developing sleeve 28 opposes the photosensitive drum 1, and supplies the developer to the electrostatic latent image formed on the photosensitive drum 1, thus developing the latent image.

At this time, in order to improve development efficiency, i.e., a rate of the toner imparted to the latent image, a developing bias voltage in the form of a DC voltage biased or superposed with an AC voltage is applied to the developing sleeve 28 from a power source. In this embodiment, the developing bias is a combination of a DC voltage of −500 V, and an AC voltage which is 1,800 V in peak-to-peak voltage Vpp and 12 kHz in frequency f. However, the DC voltage value and the AC voltage waveform are not limited to those described above.

In the two component magnetic brush developing method, generally, the application of AC voltage increases the development efficiency and therefore the image has a high quality but on the other hand, fog is liable to occur. For this reason, by providing a potential difference between the DC voltage applied to the developing sleeve 28 and the charge potential of the photosensitive drum 1 (i.e., a white background portion potential), the fog is prevented.

The regulating blade 29 is constituted by a nonmagnetic member formed with an aluminum plate or the like extending in the longitudinal axial direction of the developing sleeve 28 and by a magnetic member such as an iron material. The regulating blade 29 is disposed upstream of the photosensitive drum 1 with respect to the developing sleeve rotational direction. Both the toner and the carrier of the developer pass through the gap between a free end of the regulating blade 29 and the developing sleeve 28 and are sent to the developing position.

Incidentally, by adjusting the gap between the regulating blade 29 and the developing sleeve 28, the trimming (coating) amount of the magnetic brush chain of the developer carried on the developing sleeve 28 is regulated, so that the amount of the developer sent into the developing position is adjusted. In this embodiment, a coating amount per unit area of the developer on the developing sleeve 24 is regulated at, e.g., 30 mg/cm$^2$ by the regulating blade 29.

The gap between the regulating blade 29 and the developing sleeve 28 is set at a value in the range of 200-1,000 μm, preferably, 300-700 μm. In this embodiment, the gap is set at 500 μm.

Further, in the developing region opposing the photosensitive drum 1, the developing sleeve 28 moves in the same direction as the movement direction of the photosensitive drum 1 at a peripheral speed ratio of 1.75 by which the developing sleeve 28 moves at the peripheral speed which is 1.75 times that of the photosensitive drum 1. With respect to the peripheral speed ratio, any value may be set as long as the set value is in the range of 0-3.0, preferably, 0.5-2.0. The greater the peripheral (moving) speed ratio, the higher the development efficiency. However, when the ratio is excessively large, problems such as toner scattering and developer deterioration occur. Therefore, the ratio is desired to be set in the above-mentioned range.

The two component developer, which comprises the toner and the carrier, used in this embodiment will be described.

The toner contains primarily binder resin, and coloring agent. If necessary, particles of coloring resin, inclusive of other additives, and coloring particles having external additive such as fine particles of choroidal silica, are externally added to the toner. The toner is negatively chargeable polyester-based resin and is desired to be not less than 4 μm and not more than 10 μm, preferably not more than 8 μm, in volume-average particle size.

As for the material for the carrier, particles of iron, the surface of which has been oxidized or has not been oxidized, nickel, cobalt, manganese, chrome, rare-earth metals, alloys of these metals, and oxide ferrite are preferably usable. The method of producing these magnetic particles is not particularly limited. A weight-average particle size of the carrier may be in the range of 20-60 μm, preferably, 30-50 μm. The carrier may be not less than $10^7$ ohm·cm, preferably, not less than $10^8$ ohm·cm, in resistivity. In this embodiment, the carrier with a resistivity of $10^8$ ohm·cm was used.

[Supply of Developer]

A developer supplying method in this embodiment will be described using FIGS. 2 and 3. Above the developing device 4, a hopper 31 accommodating a two-component supply developer containing the toner and the carrier in mixture is provided. The hopper 31 constituting a toner supplying means includes a screw-shaped feeding member 32 at a lower portion thereof, and one end of the feeding member 32 extends to a position of a developer supply opening 30 provided at a front end portion of the developing device 4.

The toner in an amount corresponding to the amount of the toner consumed by image formation is supplied from the hopper 31 to the developing container 22 through the developer supply opening 30 by a rotational force of the feeding member 32 and gravitation of the developer. Thus, from the hopper 31, the developer is supplied to the developing device 4. A supply amount of the developer is roughly determined by the number of rotation of the feeding member 32, but the number of rotation of the feeding member 32 is determined by an unshown toner supply amount controlling means. As a toner supply amount controlling method, it is possible to appropriately select the method from a method of optically or magnetically detect a toner content (density) of the two-component developer and a method of detecting a density of a toner image obtained by developing a reference latent image on the photosensitive drum 1.

[Discharge of Developer]

A developer discharging method in this embodiment will be described using FIGS. 2 and 3. A side wall 22*a* of the developing container 22 is provided with a developer discharge opening 40 constituting a developer discharging means, and a deteriorated developer is discharged through the developer discharge opening 40 along an arrow in FIG. 2. When the amount of the developer in the developing device 4 is increased in a developer supplying step, depending on an increase amount, the developer is discharged through the developer discharge opening 40 in an overflow manner. That is, an excessive developer with the supply of the developer is discharged from the developing container 22 through the developer discharge opening 40. The discharged developer is fed to an unshown collected developer storing portion by a collecting screw 41 as a feeding member.

A position of the developer discharge opening 40 is disposed upstream of a position of the developer supply opening 30. This is because a fresh (new) developer supplied is prevented from being discharged immediately. In this embodiment, the developer discharge opening 40 is provided in the side wall of the upper-side developing chamber 23.

[Relationship Between Developer Discharge Opening and Screw]

A relationship between the developer discharge opening 40 and the first feeding screw 25 will be described using FIG. 4. As described above, in the developing chamber 23 of the developing container 22, the first feeding screw 25 as the feeding member is disposed. The first feeding screw 25 includes the blade 51 formed helically on a rotation shaft 50, and feeds the developer in the developing container 22 along the rotation shaft 50 by rotation thereof. In this embodiment, for example, over an axial direction of the rotation shaft 50 of 8 μm in shaft diameter, the blade 51 which is a stirring blade of 30 mm in pitch and 28 mm in outer diameter is provided uniformly along the axial direction. Also the second feeding screw 26 has the same constitution. The side wall 22*a* (FIG. 2) in the developing chamber 23 is provided with the developer discharge opening 40, and the first feeding screw 25 is disposed so as to partly oppose the developer discharge opening 40.

In an opposing side to the developer discharge opening 40, the blade 51 of the first feeding screw 25 as described above rotates from above toward below is an up-down direction in a state in which the image forming apparatus is placed. In other words, the blade 51 of the first feeding screw 25 is configured to rotate so that an opposing side (FIG. 6) thereof to the developer discharge opening 40 is directed from above toward below. In addition, the blade 51 is formed helically so that at least the opposing side of the first feeding screw 25 to the developer discharge opening 40 is such as to ascend, relative to the rotation shaft 50, toward the downstream with respect to the developer feeding direction. In other words, the blade 51 of the first feeding screw 25 is formed so that a winding direction of the blade 51 is the clockwise direction when the blade 51 is viewed from an upstream side of the developer feeding direction which is a rotational axis direction of the first feeding screw 25. In this embodiment, the blade 51 is formed similarly over an entire region of the first feeding screw 25 with respect to the axial direction, and an opposing portion of the blade 51 to the developer discharge opening 40 provided in the side wall 22*a* is formed such as to ascend toward the downstream with respect to the developer feeding direction.

[Developer Jumping Phenomenon by Screw Blade]

A developer jumping phenomenon by the blade 51 will be described using FIGS. 5 and 6. In addition to the excessive developer discharged through the developer discharge opening 40 in the overflow manner as described above, in some cases, also a necessary developer which is not the excessive developer is discharged by jumping of the developer by the blade 51 of the first feeding screw 25.

According to observation by the present inventor, such a jumping phenomenon by the blade 51 occurs in the following process. With the rotation of the blade 51, the developer in the developing container 22 is fed in such a manner that the developer is pushed by the blade 51 while stagnating on downstream-side surfaces 52 (FIG. 4A) of the blade 51 in the upstream side of the developer feeding direction of opposing surfaces of the blade 51 with respect to the axial direction. At this time, the developer receives a force with respect to also the rotational direction in addition to the axial direction with the rotation of the blade 51. Accordingly, the developer is fed in an oblique direction correspondingly to a received degree of the force in the rotational direction relative to the developer feeding direction. As a result, the developer is caused to jump toward a side surface direction in which the developer discharge opening 40 in the developing chamber 23 is located. Then, at the opposing portion where the first feeding screw 25 opposes the developer discharge opening 40, the developer caused to jump is discharged through the developer discharge opening 40, and therefore causes unnecessary discharge.

This phenomenon is more conspicuous in the case where, e.g., the blade 51 has a draft (tilt angle). Here, the draft means inclination (tilting) for permitting smooth drawing (removal) of a metal mold provided for a die molded product. If there is no draft, the molded product cannot be taken out from the metal mold, and also when the draft is excessively small, residual stress is exerted on the molded product or the like, so that a problem is liable to occur. For this reason, in the case of the die molded product, the draft has to be necessarily provided at a certain angle or more. The die molding has a large advantage from the viewpoint of cost, and therefore the die molded product is used for parts (components) such as the screw in some cases, but in the case where the die molding is made, the draft is basically provided. Accordingly, also in the case of this embodiment, the blade 51 has the draft.

Figure 5:
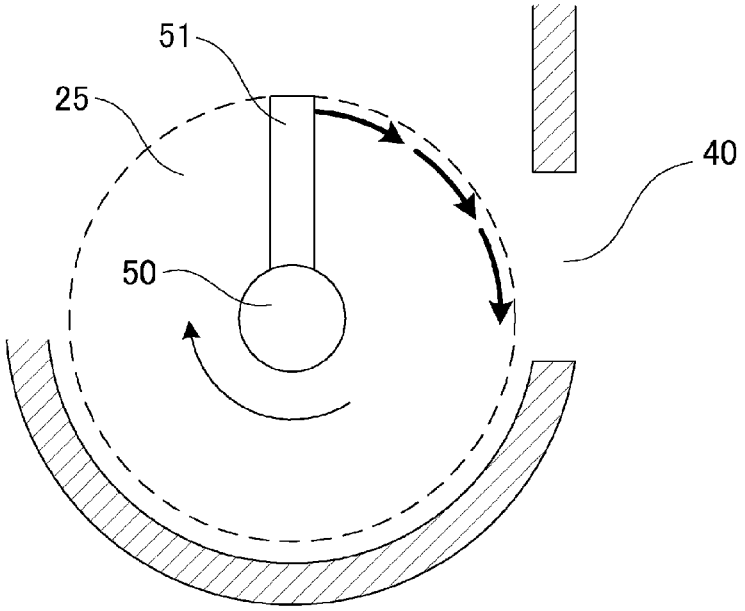
FIG. 5 is a schematic view, of a cross section of the screw perpendicular to a rotation shaft, for illustrating jumping of a developer in the developing container in the case where a blade of the screw has no draft (angle).
Figure 6:
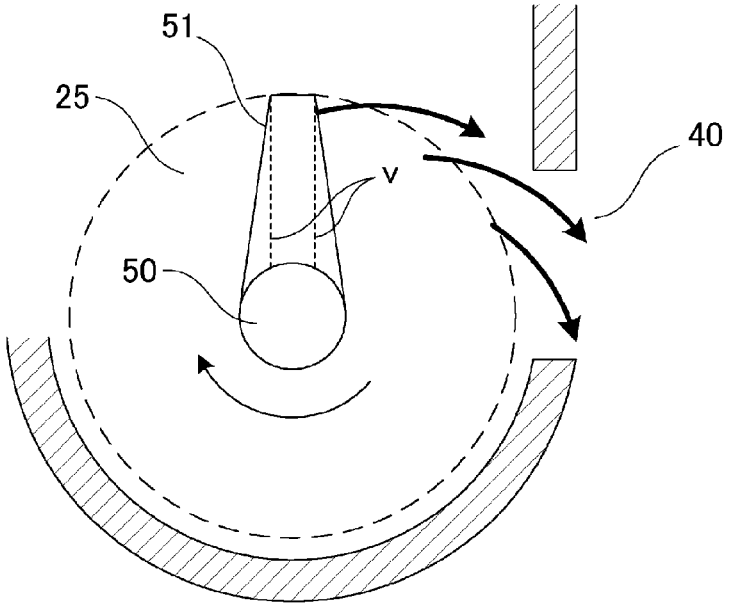
FIG. 6 is a schematic view, of a cross section of the screw perpendicular to a rotation shaft, for illustrating jumping of the developer in the developing container in the case where a blade of the screw has the draft (angle).

FIGS. 5 and 6 are sectional views in the case where the draft is not provided and the case where the draft is provided, respectively, in which a direction of a force received by the developer from the blade 51 is shown by arrows. In the case where the blade 51 has no draft, as shown in FIG. 5 by the arrows, the developer receives the force in the rotational direction (circumferential direction) of the blade 51. On the other hand, in the case where the blade 51 has the draft, the blade 51 has an angle relative to perpendicular lines v from the rotation shaft 50, and therefore as shown in FIG. 6, the developer receives the force not only in the rotational direction (circumferential direction) but also in an outward radial direction of the blade 51. For this reason, the developer receiving the force by the rotation of the first feeding screw 25 is caused to jump toward an outward direction compared with the case where the blade 51 has no draft.

As a countermeasure against the developer jumping phenomenon, it would be considered that a size of the developer discharge opening is made small. However, when the developer discharge opening is made small, there is a possibility that the decreased developer discharge opening in size has the influence on also the excessive developer to be originally discharged. That is, when the size of the developer discharge opening is made excessively small and thus also the discharge of the excessive developer is prevented, the surface of the developer is not stabilized. For this reason, also in order not to prevent the discharge of the excessive developer to be originally discharged, the developer discharge opening has the size to some degree or more. Accordingly, when the size of the developer discharge opening is only decreased, there is naturally a limit to a degree of suppression of the developer discharge due to the jumping. Therefore, in this embodiment, the developer discharge opening 40 is constituted in the following manner.

[Developer Discharge Opening]

Figure 4A:
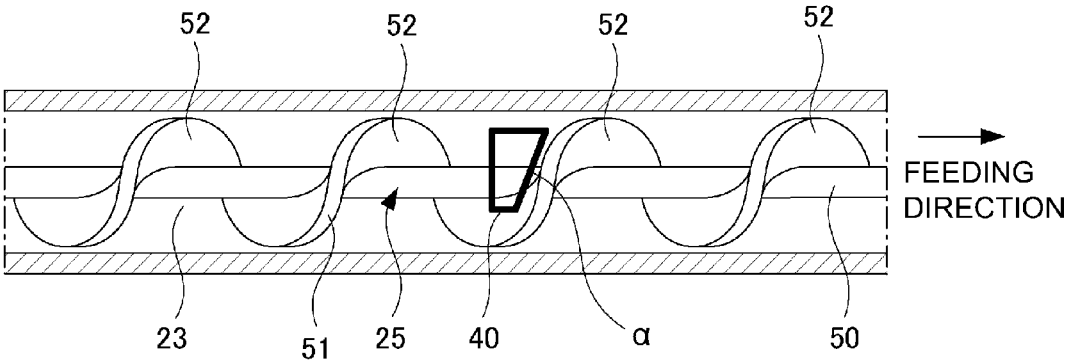
FIG. 4A is a schematic longitudinal sectional view showing a relationship between a screw and a developer discharge opening in a developing container of the developing device according to the First Embodiment.
Figure 4B:
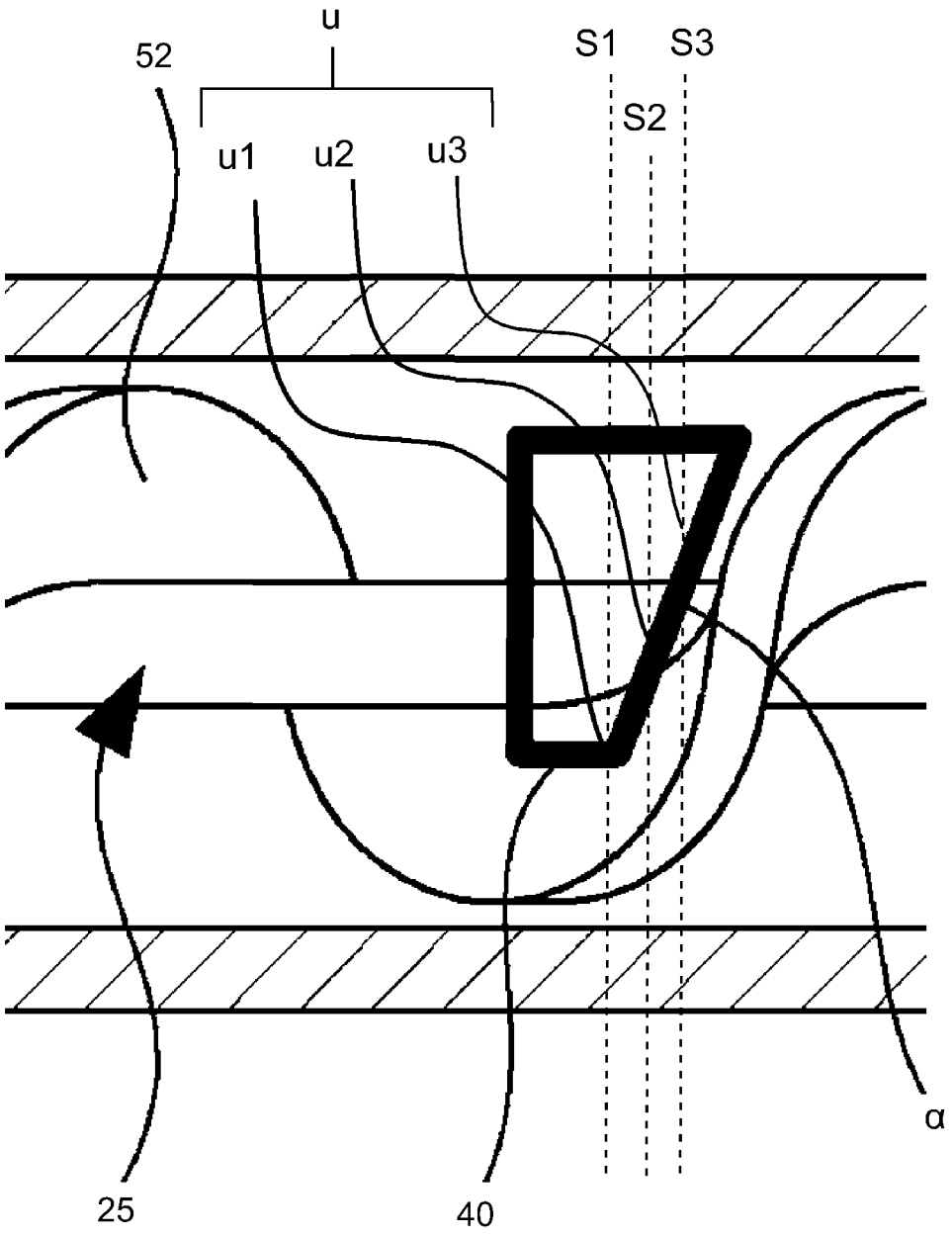
FIG. 4B is a partly enlarged view of FIG. 4A.
Figure 7:
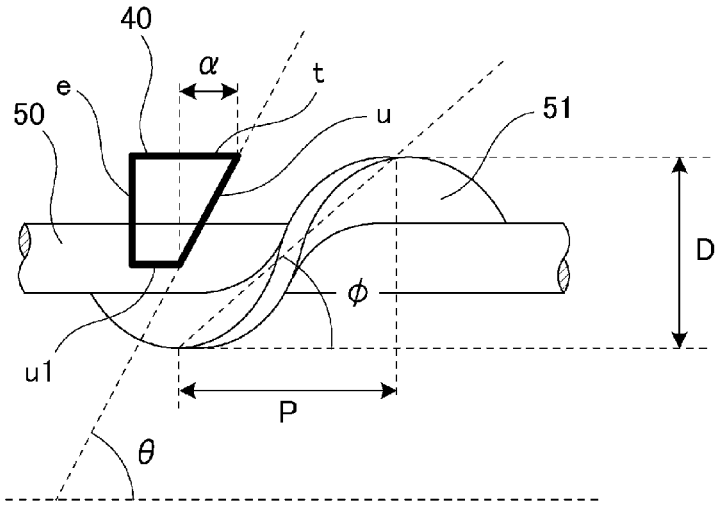
FIG. 7 is a schematic view showing a relationship a developer discharge opening and the screw blade in the First Embodiment.

A structure of the developer discharge opening 40 in this embodiment will be described using FIGS. 4A, 4B and 7 to 10. As will best be understood from FIG. 4B which is an enlarged view of the discharge opening, a bottom end (u2) of the downstream edge of said discharge opening in a first cross-section (S2) taken perpendicularly to the rotation shaft is at a higher level than that (u1) in a second cross-section (S1) at a downstream of the first cross-section with respect to the developer feeding direction. Here, the bottom end u1 is at the end of the bottom edge of the discharge opening. Similarly, as regards the relation between the cross-sections S1 and S3, a bottom end (u3) of the downstream edge of said discharge opening in a first cross-section (S3) taken perpendicularly to the rotation shaft is at a higher level than that (u1) in a second cross-section (S1) at a downstream of the first cross-section with respect to the developer feeding direction. In this example, the developer discharge opening 40 is configured as shown in FIGS. 4 and 7 so that in a side downstream, with respect to the developer feeding direction, of a position where a level of a downstream edge u with respect to the up-down direction is the lowest, the developer discharge opening 40 includes a region (predetermined region α) in which the downstream edge u is such as to ascend toward the downstream with respect to the developer feeding direction. Specifically, in the predetermined region α to a downstream end of the developer discharge opening 40 with respect to the developer feeding direction, the downstream edge u in the state in which the image forming apparatus is placed is disposed at a higher position with respect to the up down direction toward the downstream with respect to the developer feeding direction. Particularly, in this embodiment, the developer discharge opening 40 is inclined in the predetermined region α so that the downstream edge u is such as to ascend toward the downstream with respect to the developer feeding direction. Here, the blade 51 is formed so that the opposing portion thereof to the developer discharge opening 40 provided in the side wall 22*a* is such as to ascend toward the downstream with respect to the developer feeding direction. Accordingly, the downstream edge u of the developer discharge opening 40 in the predetermined region α is inclined in a direction along a shape of the opposing portion of the blade 51 to the side wall 22*a*.

Further, the downstream edge u of the developer discharge opening 40 in the predetermined region α is inclined within a predetermined angle relative to an inclination angle ϕ, defined below, of the blade 51 relative to the rotation shaft 50 at the opposing portion of the blade 51 to the developer discharge opening 40. As shown in FIG. 7, in the case where an outer diameter of the blade 51 positioned at the opposing portion to the developer discharge opening 40 is D and a half pitch of the blade 51 is P, the inclination angle ϕ of the blade 51 is expressed by tan ϕ=D/P. The downstream edge u of the developer discharge opening 40 in the predetermined region α is inclined within a predetermined angle relative to the inclination angle ϕ of the blade 51, e.g., within ±30°, preferably within ±20°. In this embodiment, an inclination angle θ of the downstream edge u of the developer discharge opening 40 is made larger than the inclination angle ϕ of the blade 51.

Incidentally, as described hereinafter, the inclination angle θ of the downstream edge u of the developer discharge opening 40 may preferably be the same as the inclination angle ϕ of the blade 51. Further, the shape of the downstream edge u of the developer discharge opening 40 may preferably be made close to a shape of the opposing portion of the blade 51 to the developer discharge opening 40. For this reason, the definition of the inclination angle ϕ of the blade 51 is not limited to the above-described definition, but may also be another definition. For example, when the shape of the opposing portion of the blade 51 to the developer discharge opening 40 draws a sine curve, the inclination angle ϕ may also be defined as an angle of tangential line passing through an inflection point of the sine curve (relative to the rotation shaft). Alternatively, the inclination angle ϕ may also be defined, depending on a positional relationship with the blade 51, as an angle of, e.g., a tangential line passing through a position of the blade 51, of the opposing portion of the blade 51, opposing a center position of the downstream edge u with respect to the up-down direction (relative to the rotation shaft).

Further, the predetermined region α in which the downstream edge u of the developer discharge opening 40 is such as to ascend toward the downstream with respect to the developer feeding direction may preferably be a region of 50% or more of a maximum length of the developer discharge opening 40 with respect to the developer feeding direction. This is because an opening area of the developer discharge opening 40 is ensured while forming the downstream edge u in the predetermined region α as described above. In other words, this is because when the predetermined region α is less than 50% of the maximum length of the developer discharge opening 40 with respect to the developer feeding direction, there is a possibility that the opening area of the developer discharge opening 40 cannot be ensured and thus the excessive developer cannot be properly discharged. However, depending on the shape of the developer discharge opening 40, the predetermined region α may also be not required to satisfy the above condition. In summary, the predetermined region α is set as described later so that the discharge of the developer due to the jumping can be suppressed and the opening area for permitting proper discharge of the excessive developer can be ensured.

Further, in this embodiment, with respect to the developer discharge opening 40, a length (lateral width) with respect to the developer feeding direction of an upper end t with respect to the up-down direction is made longer than a length (lateral width) with respect to the developer feeding direction a lower end u1 upstream of the draft region α with respect to the developer feeding direction. As a result, the lateral width of the developer discharge opening 40 broadens from the lower end toward the upper end. For this reason, the developer is not readily discharged in the case where the developer amount is proper and the developer surface is relatively low, but the lateral width gradually broadens when the developer amount increases and the developer surface becomes higher than an assumed level, and therefore the developer is more easily discharged. As a result, the developer surface of the developer in the developing container 22 is easily returned to a proper developer surface. Such a behavior is more effective in maintaining the developer surface at a certain level.

Further, in order to reduce a degree of the discharge of the developer due to the jumping of the developer by the blade 51, it is desirable that the developer discharge opening 40 is made smaller, but as described above, when the developer discharge opening 40 is made smaller, there is a possibility that the discharge of the developer to be originally discharged is prevented. On the other hand, in this embodiment, the lateral width of the developer discharge opening 40 increases with an increasing amount of the developer, and therefore it becomes possible to suppress the developer discharge due to the jumping without preventing the discharge of the excessive developer to be originally discharged.

In order to effectively obtain such an effect, the lateral width of the lower end u1 of the developer discharge opening 40 may preferably be made not more than ½ of the lateral width of the upper end t of the developer discharge opening 40. For this reason, in this embodiment, the shape of the developer discharge opening 40 was 12 mm in length (height) with respect to the up-down direction, 8 mm in lateral width of the upper end t and 4 mm in lateral width of the lower end u1.

Further, in this embodiment, the lower end u1 of the developer discharge opening 40 is unchanged in position thereof even in the upstream side with respect to the developer feeding direction, and upstream ends of the lower end u1 and the upper end t are vertically connected by an upstream edge e of the developer discharge opening 40. In other words, the upstream edge e of the developer discharge opening 40 with respect to the developer feeding direction is not inclined. However, the upstream edge e may also be inclined from the vertical direction. In this case, a range of an inclination angle of the upstream edge e relative to the rotation shaft 50 is made larger than an angle parallel to the inclination angle θ of the downstream edge u in the above-described predetermined region α and is made smaller than an angle obtained by rotating this inclination angle by 180° in the case where the counterclockwise rotational direction in FIG. 7 is a positive rotational direction. In other words, when the inclination angle of the side edge e relative to the rotation shaft 50 is τ, the inclination angle is set in a range of $\theta<\tau<(180°-\theta)$.

This is because in the case where τ is not less than (180°−θ), as described later, a time of movement of the opposing portion of the blade 51 to the developer discharge opening 51 through the opposing region to the developer discharge opening 40 becomes long and thus an effect of suppressing the developer discharge due to the jumping is lowered. In addition, in the case where τ is θ or less, the lateral width of the developer discharge opening 40 is constituted so as to be the same or so as to narrow from the lower end toward the upper end. In such a constitution, as described above, such an effect that the developer surface in the developing container 22 is easily returned to the proper developer surface is not readily obtained.

As described above, in the case of this embodiment, the developer discharge opening 40 is constituted so that the downstream edge u is positioned at a higher level toward the downstream with respect to the developer feeding direction in the predetermined region α to the downstream end of the developer discharge opening 40 with respect to the developer feeding direction. For this reason, it is possible to sufficiently suppress the developer discharge due to the jumping. That is, in the predetermined region α, the downstream edge u of the developer discharge opening 40 is positioned at the higher level toward the downstream with respect to the developer feeding direction, and therefore the developer is less discharged toward the downstream with respect to the developer feeding direction due to the jumping at a lower portion of the developer discharge opening 40.

This will be described specifically. As described above, the developer is subjected to the force also with respect to the rotational direction in addition to the axial direction with the rotation of the blade 51, and is fed in the oblique direction relative to the feeding direction correspondingly to an amount of a component of the force with respect to the rotational direction. The developer caused to jump by the blade 51 is discharged in large amount below the developer discharge opening 40 also by the influence of gravitation. Accordingly, there is a tendency that the amount of the developer caused to jump by the blade 51 becomes larger toward the downstream with respect to the developer feeding direction.

On the other hand, in this embodiment, the constitution in which the downstream edge u of the developer discharge opening 40 in the predetermined region α is made higher at the position closer to the downstream end with respect to the developer feeding direction is employed. For this reason, the developer caused to jump in a downward direction toward the downstream with respect to the developer feeding direction abuts against the side wall 22*a* in the downstream side of the downstream edge u of the developer discharge opening 40, so that the discharge of the developer through the developer discharge opening 40 is suppressed.

In this embodiment, the inclination angle θ of the downstream edge u of the developer discharge opening 40 is made larger than the inclination angle τ of the blade 51 at the opposing portion to the developer discharge opening 40. According to study by the present inventor, by employing such a constitution, the jumping of the developer is suppressed. This is for the following reason. In the case of a constitution in which the blade 51 rotates from above toward below at the opposing portion to the developer discharge opening 40 as in the constitution of this embodiment, the jumping of the developer by the blade 51 is liable to generate in a larger degree at a portion above the blade 51. This is because as shown in FIGS. 5 and 6, the force received by the developer from the blade 51 is directed in a larger degree toward the side wall 22*a* provided with the developer discharge opening 40 with a degreasing distance to an upper portion of the blade 51. Accordingly, there is a possibility that the developer caused to jump by the blade 51 is discharged also at the upper portion of the developer discharge opening 40 although being affected by the gravitation. Accordingly, the inclination angle θ of the downstream edge u is made larger than the inclination angle ϕ of the blade 51, so that the upper portion of the blade 51 is readily hidden from the opening region of the developer discharge opening 40, and thus it is possible to more effectively suppress the discharge of the developer due to the jumping at this portion.

Figure 8:
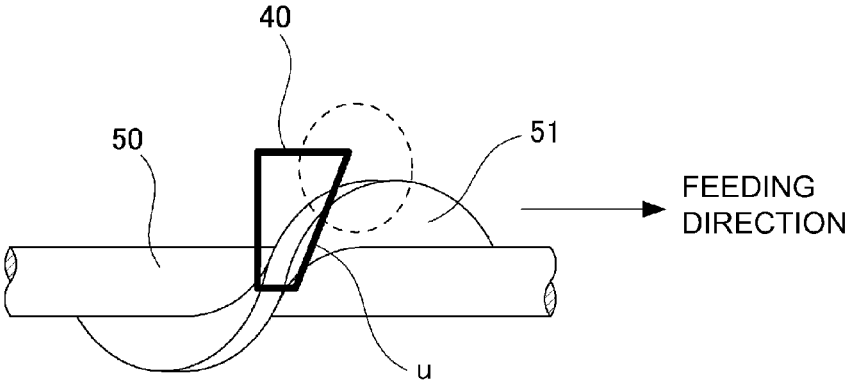
FIG. 8 is a schematic view showing a relationship between the developer discharge opening and the screw in the case where an inclination angle θ of a lower end of the developer discharge opening is larger than an angle ϕ of the screw blade.
Figure 9:
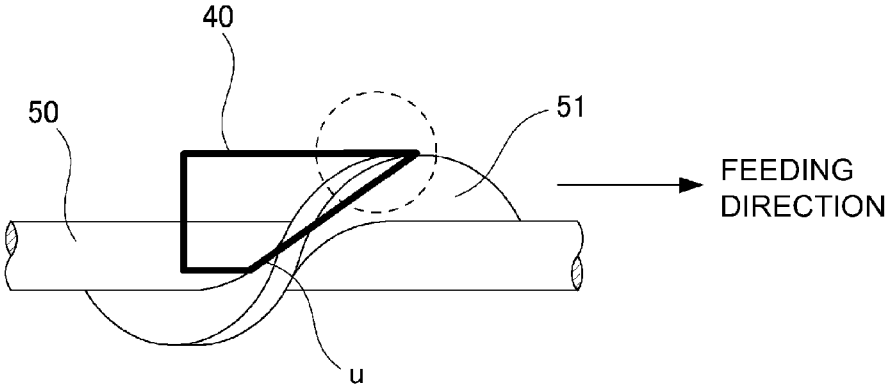
FIG. 9 is a schematic view showing a relationship between the developer discharge opening and the screw in the case where the inclination angle θ of the lower end of the developer discharge opening is smaller than the angle ϕ of the screw blade.

This will be described using FIGS. 8 and 9. In FIGS. 8 and 9, for easy understanding of explanation, a state in which the rotating blade 51 just reaches the neighborhood of the opposing position of the downstream edge u to the developer discharge opening 40 is shown. As shown in FIG. 8, in the case where the inclination angle θ of the downstream edge u of the developer discharge opening 40 is larger than the inclination angle ϕ of the blade 51, the upper portion of the blade 51 encircled by a broken line is hidden by the wall surface downstream of the downstream edge u of the developer discharge opening 40 earlier than the lower portion of the blade 51. For this reason, the discharge of the developer due to the jumping at the upper portion of the blade 51 is efficiently suppressed. On the other hand, as shown in FIG. 9, in the case where the inclination angle θ of the downstream edge u of the developer discharge opening 40 is smaller than the inclination angle ϕ of the blade 51, the lower portion of the blade 51 encircled by a broken line is hidden by the wall surface downstream of the downstream edge u of the developer discharge opening 40 earlier than the upper portion of the blade 51. For this reason, the discharge of the developer due to the jumping at the upper portion of the blade 51 is relatively liable to occur. For this reason, when the inclination angle θ of the downstream edge u of the developer discharge opening 40 is made larger than the inclination angle ϕ of the blade 51, the discharge of the developer due to the jumping at the upper portion of the blade 51 can be suppressed efficiently.

However, it is preferable that the inclination angle θ of the downstream edge u of the developer discharge opening 40 is the same as the inclination angle ϕ of the blade 51. That is, for the reason described above, although the inclination angle θ of the downstream edge u of the developer discharge opening 40 is made larger than the inclination angle ϕ of the blade 51, in this case, there is a possibility that the discharge of the developer due to the jumping at the lower portion cannot be sufficiently suppressed. Accordingly, in order to efficiently suppress the discharge of the developer due to the jumping, the opposing portion of the blade 51 to the developer discharge opening 40 may preferably be hidden by the wall surface downstream of the downstream edge u of the developer discharge opening 40 substantially simultaneously over the up-down direction.

On the other hand, timing when the opposing portion of the blade 51 to the developer discharge opening 40 is hidden in the up-down direction by the wall surface downstream of the downstream edge u of the developer discharge opening 40 is not necessarily be required to the same, but when the timing is close timing, the discharge suppressing effect becomes high. For this reason, as described above, the downstream edge u of the developer discharge opening 40 in the predetermined region α is inclined within the predetermined range relative to the inclination angle ϕ of the blade 51, e.g., within the range of ±30°, preferably within the range of ±20°.

Figure 10:
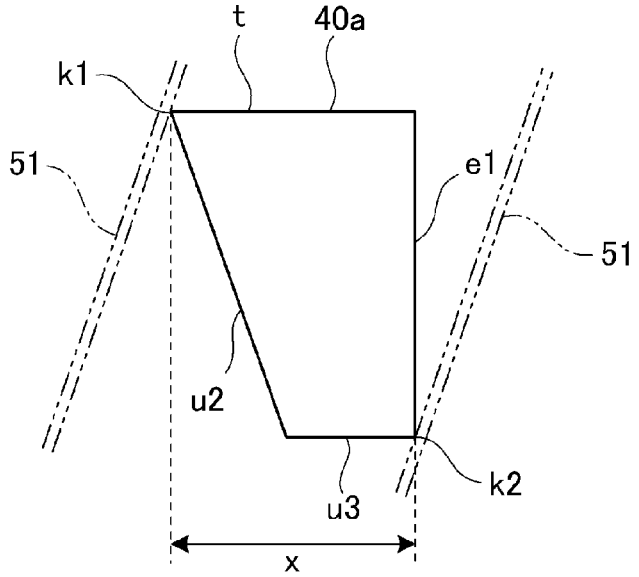
In FIG. 10, (a) and (b) are schematic views each showing a movement amount of the screw blade, in which (a) shows the case where a lower end of the developer discharge opening inclines such as to ascend toward an upstream with respect to the developer feeding direction, and (b) shows the case where the lower end of the developer discharge opening inclines such as to ascend toward a downstream with respect to the developer feeding direction.
Figure 10:
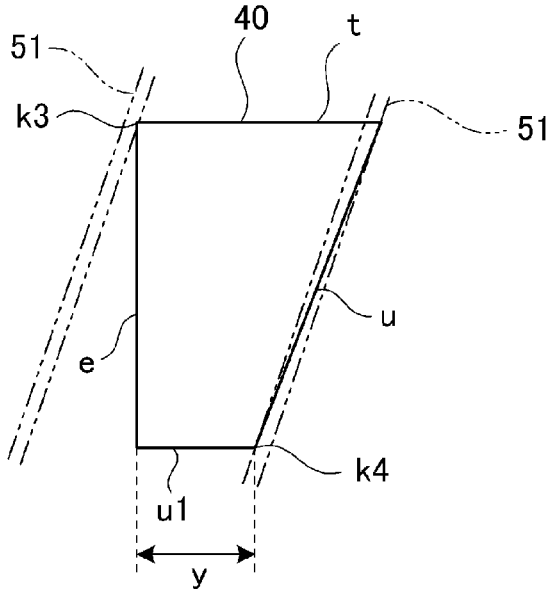

In the case of this embodiment, in the predetermined α of the developer discharge opening 40, the downstream edge u is positioned at the higher level with the degreasing distance to the downstream side of the developer feeding direction, and therefore the time of the movement of the opposing portion of the blade 51 to the developer discharge opening 40 through the opposing region to the developer discharge opening 40 can be shortened. For this reason, the discharge of the developer due to the jumping can be more efficiently suppressed. This will be described using FIG. 10. In FIG. 10, (a) shows a comparison example which is the case where a lower end u2 of a developer discharge opening 40*a* is inclined upward with a degreasing distance to an upstream side of the developer feeding direction. In FIG. 10, (b) shows the developer discharge opening 40 in this embodiment. The opening area of each of the developer discharge opening 40*a* in (a) of FIG. 10 and the developer discharge opening 40 in (b) of FIG. 10 is the same. In each of (a) and (b) of FIG. 10, the case where the opposing portion of the blade 51 is larger than the length of the developer discharge openings 40*a*, 40 and the blade 51 is positioned at the upstream end and the downstream end of the developer discharge openings 40*a*, 40 with respect to the developer feeding direction is schematically illustrated.

In the case of the constitution shown in (a) of FIG. 10, the opposing portion of the blade 51 moves from a corner portion k1 between the upstream end of an inclined lower end u2 and the upstream end of an upper end t to a corner portion k2 between the downstream and of a lower end u3 downstream of the lower end u2 and a side edge e1 in the downstream side. At this time, a movement distance of the opposing portion of the blade 51 is x. On the other hand, in the case of the constitution shown in (b) of FIG. 10, the opposing portion of the blade 51 moves from a corner portion k3 between the side edge 1 and the upstream end of the upper end t to a corner portion k4 between the inclined downstream edge u and the downstream end of the lower end u1 upstream of the lower end u. At this time, a movement distance of the opposing portion of the blade 51 is y.

Here, a maximum length (length of the upper end t) of the developer discharge opening 40*a* with respect to the developer feeding direction in (a) of FIG. 10 and a maximum length (length of the upper end t) of the developer discharge opening 40 with respect to the developer feeding direction in (b) of FIG. 10 are the same. Further, each of the downstream side edge e1 of the developer discharge opening 40*a* in (a) of FIG. 10 and the upstream edge e of the developer discharge opening 40 in (b) of FIG. 10 extends vertically. Then, in the case of the constitution shown in (a) of FIG. 10, the movement distance x of the opposing portion of the blade 51 is the maximum length of the developer discharge opening 40*a*. On the other hand, in the case of the constitution shown in (b) of FIG. 10, the movement distance y of the opposing portion of the blade 51 is smaller than the movement distance x correspondingly to the inclination of the downstream downstream edge u which is such as to ascend toward the downstream with respect to the developer feeding direction.

Accordingly, in the case of the constitution of (b) of FIG. 10 in this embodiment, the time of the movement of the opposing portion of the blade 51 to the developer discharge opening 40 through the opposing region to the developer discharge opening 40 can be made shorter than that in the constitution of (a) of FIG. 10. That is, in this embodiment, the opposing portion of the blade 51 is formed such as to ascend toward the downstream with respect to the developer feeding direction, and therefore the downstream edge u of the developer discharge opening 40 is inclined in the same direction, so that the time of the movement of the opposing portion of the blade 51 through the opposing region to the developer discharge opening 40 can be shortened.

When the first screw 25 rotates for feeding the developer, apparently, the opposing portion of the blade 51 moves in the developer feeding direction through the opposing region to the developer discharge opening 40, so that during this movement, the discharge of the developer due to the jumping is made. In the case of this embodiment, the movement time can be shortened as described above, a time of the discharge of the developer due to the jumping can be shortened, with the result that the discharge of the developer due to the jumping can be suppressed efficiently.

Figure 11:
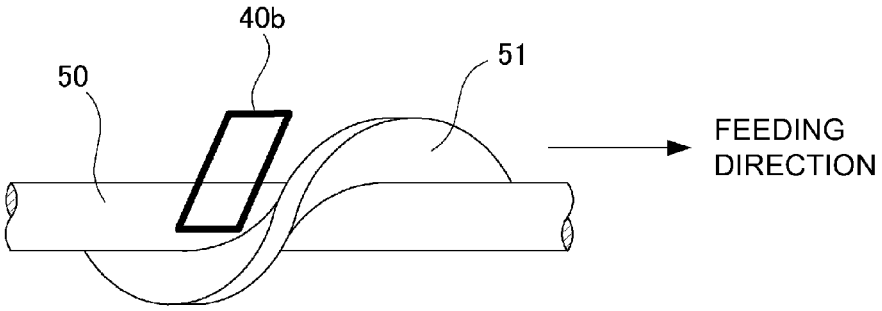
FIG. 11 is a schematic view showing a relationship between another example of the developer discharge opening and the screw in the First Embodiment.

Incidentally, the shape of the developer discharge opening in this embodiment is not limited to the above-described shape. That is, the developer discharge opening 40 may only be required to include a region where a lower end thereof is positioned at a higher level toward the downstream with respect to the developer feeding direction in a side downstream, with respect to the developer feeding direction, of a position where a level of the lower end with respect to the up-down direction is the lowest. For this reason, as shown in FIG. 11, similarly as in the case of a lower end of a developer discharge opening 40*b* in a predetermined region, also an upper end to an upstream end of the developer discharge opening 40*b* with respect to the developer feeding direction may be inclined in the same direction, for example. That is, the developer discharge opening may also be formed in a parallelogram shape.

Figure 12:
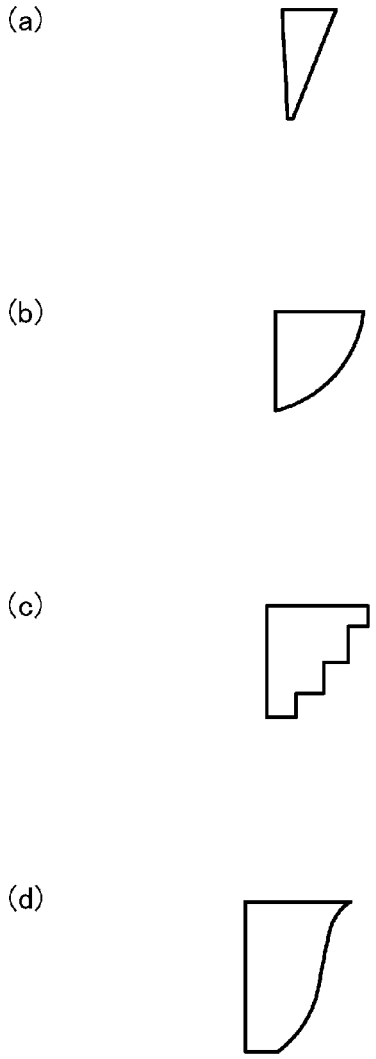
In FIG. 12, (a) to (d) are schematic views showing four other examples of the developer discharge opening in the First Embodiment.
Figure 13:
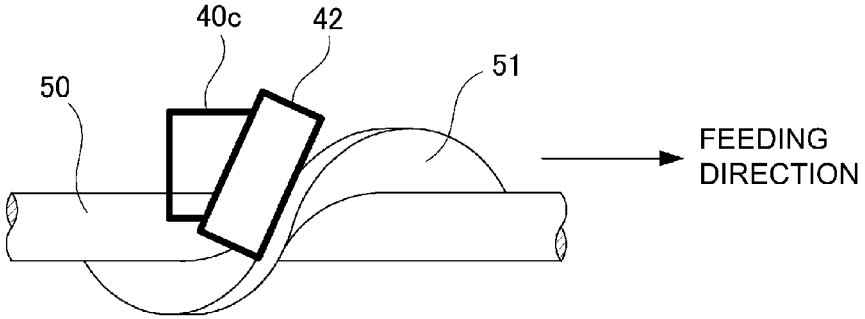
FIG. 13 is a schematic view showing a relationship between another example of the developer discharge opening and the screw in the First Embodiment.

Further, the developer discharge opening may also be formed in shapes as shown in FIG. 12, for example. That is, the developer discharge opening may also be formed in a triangular shape as shown in (a) of FIG. 12, a shape having a curved lower end as shown in (b) of FIG. 12, a shape having a stepped lower end as shown in (c) of FIG. 12, and a shape having a sine-curved lower end along the opposing portion of the blade as shown in (d) of FIG. 12. Further, the developer discharge opening may also be constituted using a plurality of members as shown in FIG. 13, in which a sheet-like member 42 is disposed in an inclined state relative to a rectangular opening 40*c* so as to partly cover the opening 40*c*. In this case, a side edge defined by partly covering the opening 40*c* with the member 42 constitutes a lower end of the developer discharge opening. Further, in a region further downstream of a region where the lower end of the developer discharge opening is positioned at a higher level toward the downstream with respect to the developer feeding direction, a portion positioned below a lower end position in a further upstream side may also be formed. However, this portion positioned below the lower end position is positioned above a position (lowest end position) where a level of the lower end, with respect to the up-down direction, upstream of the region is the lowest. In summary, in the side downstream of the lowest position of the developer discharge opening, if a constitution including a region such as to ascend toward the downstream with respect to the developer feeding direction is employed, in a side downstream of the region, the developer discharge opening may also be formed so that the lower end position is somewhat lowered at a position higher than the lowest end position.

<Second Embodiment>

A Second Embodiment of the present invention will be described using FIGS. 14 and 15. In the case of this embodiment, first screws 25*a*, 25*b* as the feeding member are formed so that a developer feeding force (power) per unit length in a predetermined range C upstream of the developer discharge opening 40 with respect to the developer feeding direction is made lower than that in a range opposing the developer discharge opening 40. First, in the case of a constitution shown in FIG. 14, the first feeding screw 25*a* is not provided with the blade 51 in the predetermined range C upstream of the developer discharge opening 40 with respect to the developer feeding direction.

Figure 3:
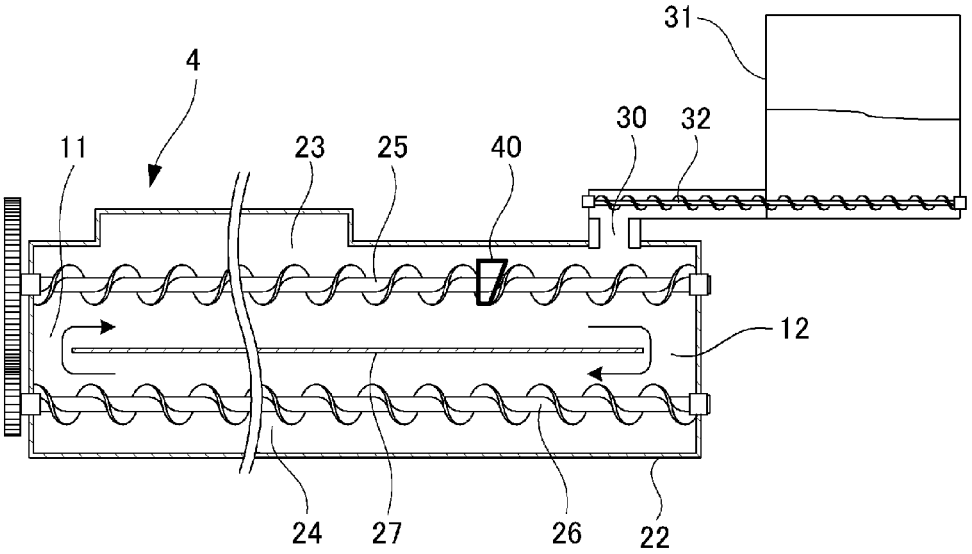
FIG. 3 is a schematic longitudinal sectional view of the developing device according to the First Embodiment.

As described in the First Embodiment, the developer in the developing container 22 is fed in such a manner that with the rotation of the blade 51, the developer is pushed by the blade 51 while stagnating on the downstream-side surface 52 of the blade 51 in the upstream side, with respect to the feeding direction, of the blade 51 opposing the axial direction (FIGS. 3 and 4). The developer stagnating on the surface 52 of the developing screw blade 51 is liable to be subjected to the force from the blade 51, so that unnecessary discharge of the developer due to the jumping is liable to occur. Accordingly, if an amount of the developer stagnating on the surface 52 of the developing screw blade 51 at least in the neighborhood of the developer discharge opening 40 can be decreased, it becomes possible to reduce a degree of the unnecessary discharge of the developer due to the jumping.

For this reason, in this embodiment, the blade of the blade 51 of the first feeding screw 25 is omitted in the predetermined range C upstream of the developer discharge opening 40 with respect to the developer feeding direction. As a result, the developer stagnating on the surface 52 of the blade 51 while being fed inside the developing container 22 once lowers in feeding force at the portion where the blade 51 is omitted. Then, in a side downstream of the predetermined range C, the developer starts stagnation again on the surface 52 of the blade 51. However, in an initial stage of the stagnation, an amount of the developer stagnating on the surface 52 of the blade 51 is small, and therefore also an amount of the developer caused to jump by the blade 51 is small. A region in the side, downstream of the predetermined range C, in which the stagnation of the developer starts is the region opposing the developer discharge opening 40. Accordingly, in the region opposing the developer discharge opening 40, the amount of the developer caused to jump by the blade 51 becomes small, and therefore the discharge of the developer due to the jumping can be further suppressed.

In this embodiment, an omission width of the blade 51 shown by the predetermined range C was 8 mm, but if this predetermined range C is 2 mm or more, a sufficient effect can be obtained. However, when the predetermined range C is excessively long, there is no feeding power of the screw in that range, and therefore there is a possibility that the developer stagnates. For this reason, the predetermined range C may preferably be 20 mm or less.

Further, with respect to the position of the predetermined range C, if the predetermined range C is provided in the side upstream of the developer discharge opening 40 with respect to the developer feeding direction, the effect of the present invention is obtained not a little, but is higher when the predetermined range C is provided at a position not remoter from the developer discharge opening 40. According to study by the present inventor, when the predetermined range C was provided within one pitch (30 mm in this embodiment) of the blade 51 from the developer discharge opening 40, the amount of the developer stagnating on the surface 52 of the blade 51 at the opposing portion to the developer discharge opening 40 was able to be reduced. In this embodiment, the blade 51 was omitted in a range starting from a position upstream of the developer discharge opening 40 by 8 mm to a position upstream of the 1 mm-upstream position of the developer discharge opening 40.

Figure 14:
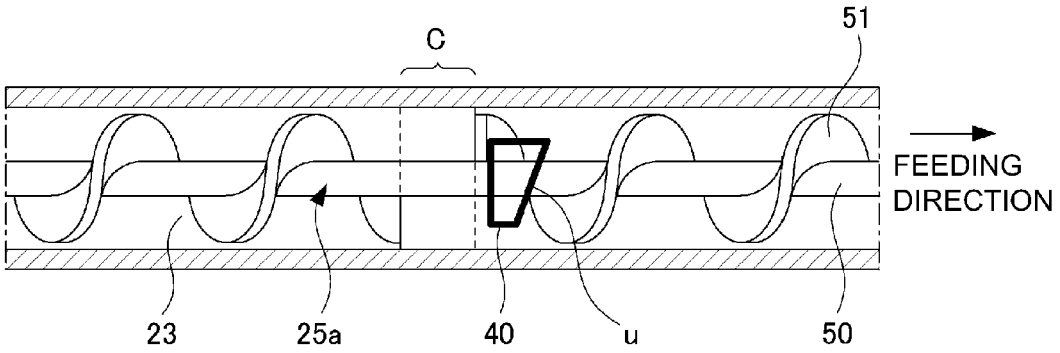
FIG. 14 is a schematic view showing a relationship between a developer discharge opening and a screw blade in a developing device according to a Second Embodiment of the present invention.
Figure 15:
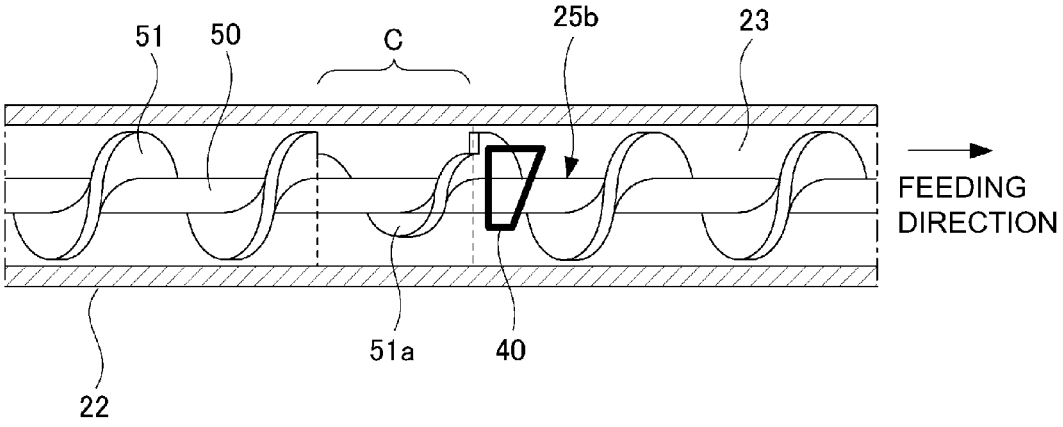
FIG. 15 is a schematic view showing a relationship between a developer discharge opening and a screw blade in another example of the developing device according to the Second Embodiment.

In the constitution shown in FIG. 14, the blade 51 of the first feeding screw 25*a* was omitted in the predetermined range C. However, as shown in FIG. 15, the first feeding screw 25*b* may also be formed so that an outer diameter of a blade 51*a* in a predetermined range C upstream of the developer discharge opening 40 with respect to the developer feeding direction is made smaller than an outer diameter of the blade 51 in a range opposing the developer discharge opening 40. By employing such a constitution, the developer feeding force in the predetermined range C lowers, and therefore an effect similar to that in the constitution of FIG. 14 can be obtained. Other constitutions and actions in this embodiment are similar to those in the First Embodiment.

According to the present invention, the developer discharge opening is constituted so as to include the region where the lower end thereof is such as to ascend toward the downstream with respect to the developer feeding direction in the side downstream of the position, where the lower end level is lowest, with respect to the developer feeding direction.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-193466 filed on Sep. 24, 2014, which is hereby incorporated by reference herein in its entirety.

What is claimed is:

1. A developing device comprising:

a developing container for accommodating a developer;

a feeding member, including a blade helically extending on a rotation shaft, for feeding the developer in said developing container along the rotation shaft by rotation thereof in a downstream developer feeding direction; and a discharge opening for permitting discharge of excessive developer, with supply of the developer from said developing container, said discharge opening being provided in a side surface of said developing container opposing said feeding member and being configured to open independently of an amount of the developer in said developing container, wherein in an overlapping region with said discharge opening, said blade is rotatable such that said blade moves the developer in the downstream developer feeding direction at a side opposing said discharge opening, wherein in the overlapping region with said discharge opening, a winding direction of said blade is such as to ascend toward the downstream developer feeding direction, and wherein when a first lower intersection position, with respect to a gravitational direction, between a downstream edge of said discharge opening and a first cross-section perpendicular to a rotational axis of said feeding member and crossing said discharge opening is a first position, and when a second lower intersection position, with respect to the gravitational direction, between the downstream edge of said discharge opening and a second cross-section which is perpendicular to the rotational axis of said feeding member and crossing said discharge opening and which is provided downstream of the first cross-section with respect to the developer feeding direction of said feeding member is a second position, said discharge opening is configured so that the second position is higher than the first position.

2. A developing device according to claim 1, wherein said discharge opening as seen from a horizontal direction perpendicular to the rotational axis of said feeding member, with respect to a rotational axis direction of said feeding member, includes an inclined portion where the downstream edge of said discharge opening is inclined so that a height of the downstream edge of said discharge opening at the first position is lower than a height of the downstream edge of said discharge opening at the second position downstream of the first position with respect to the downstream developer feeding direction.

3. A developing device according to claim 2, wherein when an inclination angle of the inclined portion is expressed by $\tan \phi = D/P$ where D is an outer diameter of said blade and P is a half pitch of said blade, the inclination angle of the inclined portion is set to within ±20 degrees relative to an inclination angle of said blade positioned at a portion opposing said discharge opening.

4. A developing device according to claim 2, wherein with respect to the rotational axis direction of said feeding member, a region of the inclined portion is 50% or more of a region where said discharge opening is formed.

5. A developing device according to claim 1, wherein said feeding member includes a region where said blade is not formed at a portion upstream of an opposing portion to said discharge opening by one pitch.

6. A developing device according to claim 1, wherein said feeding member includes a region where at a portion upstream of an opposing portion to said discharge opening by one pitch, an outer diameter of said blade is smaller than an outer diameter of said blade in the opposing portion to said discharge opening.

7. A developing device according to claim 1, wherein said discharge opening has a first widthwise length at a first level and a second widthwise length at a second level lower than the first level, the second widthwise length being shorter than the first widthwise length.

8. A developing device according to claim 1, wherein when an angle formed between the downstream edge of said discharge opening with respect to the downstream developer feeding direction and a lower edge of said discharge opening is $\theta 1$, and an angle formed between an upstream edge of said discharge opening with respect to the developer feeding direction and the lower edge of said discharge opening is $\theta 2$, the following relationship is satisfied:

$$\theta 1 < \theta 2 < 180 - \theta 1.$$

9. A developing device comprising:

a developing container for accommodating a developer;

a feeding member, including a blade helically extending on a rotation shaft, for feeding the developer in said developing container along the rotation shaft by rotation thereof in a downstream developer feeding direction; and a discharge opening for permitting discharge of excessive developer, with supply of the developer from said developing container, said discharge opening being provided in a side surface of said developing container and being configured to open independently of an amount of the developer in said developing container, wherein said blade is rotatable such that said blade moves the developer in the downward developer feeding direction at a side opposing said discharge opening, wherein a winding direction of said blade is such as to ascend toward the downstream developer feeding direction, and wherein said discharge opening includes an inclined surface at a downstream edge such that a lower edge of said discharge opening is shorter than an upper edge of said discharge opening, and wherein said feeding member includes a region where at a portion upstream of an opposing portion to said discharge opening by one pitch, an outer diameter of said blade is smaller than an outer diameter of said blade at the opposing portion to said discharge opening.

* * * * *